US010099344B2

(12) United States Patent
Sergio et al.

(10) Patent No.: US 10,099,344 B2
(45) Date of Patent: Oct. 16, 2018

(54) DRY ICE AND ABBRASIVE BLASTING MEDIA APPARATUS AND METHOD

(71) Applicants: Joseph P. Sergio, Niles, MI (US); Anthony P. Sergio, Niles, MI (US); Alan C. Scott, Niles, MI (US)

(72) Inventors: Joseph P. Sergio, Niles, MI (US); Anthony P. Sergio, Niles, MI (US); Alan C. Scott, Niles, MI (US)

( * ) Notice: Subject to any disclaimer, the term of this patent is extended or adjusted under 35 U.S.C. 154(b) by 29 days.

(21) Appl. No.: 15/490,407

(22) Filed: Apr. 18, 2017

(65) Prior Publication Data

US 2017/0297166 A1 Oct. 19, 2017

Related U.S. Application Data

(60) Provisional application No. 62/324,483, filed on Apr. 19, 2016.

(51) Int. Cl.
*B24C 1/00* (2006.01)
*B24C 3/12* (2006.01)
*B24C 5/04* (2006.01)

(52) U.S. Cl.
CPC ..... *B24C 1/003* (2013.01); *B24C 1/00* (2013.01); *B24C 3/12* (2013.01); *B24C 5/04* (2013.01)

(58) Field of Classification Search
CPC .. B24C 1/00; B24C 1/003; B24C 3/12; B24C 5/02; B24C 5/04
USPC ..... 451/38, 39, 40
See application file for complete search history.

(56) References Cited

U.S. PATENT DOCUMENTS 4,655,847 A * 4/1987 Ichinoseki ..... B24C 7/0092 134/7
4,924,643 A * 5/1990 Buiguez ..... B24C 1/003 451/39
5,044,129 A * 9/1991 Olevitch ..... B24C 1/003 451/40
5,315,793 A * 5/1994 Peterson ..... B24C 1/003 451/2
5,319,946 A * 6/1994 Manificat ..... B24C 1/003 134/7
5,415,584 A * 5/1995 Brooke ..... B08B 7/00 134/7
6,315,639 B1 * 11/2001 Kipp ..... B24C 1/003 451/102
9,975,216 B2 * 5/2018 Solenthaler ..... B24C 7/0069
2002/0166328 A1 * 11/2002 Visaisouk ..... B24C 1/003 62/66

(Continued)

*Primary Examiner* — Eileen Morgan
(74) *Attorney, Agent, or Firm* — Taylor IP, P.C.

(57) ABSTRACT

A sublimating and abrasive media blasting system including an air compressor, a sublimating blasting unit operably connected to the air compressor and configured to supply a sublimating material, and an abrasive media container operably connected to the air compressor and configured to supply an abrasive media. The blasting system also includes a blasting applicator assembly operably connected to the abrasive media container and to the sublimating blasting unit such that the blasting applicator receives the sublimating material and the abrasive media. The blasting applicator assembly includes an applicator operably connected to the sublimating blasting unit, a first trigger configured to control a flow of the sublimating material and a second trigger configured to control a flow of the abrasive media, an injector, and a nozzle.

19 Claims, 5 Drawing Sheets

(56) References Cited

U.S. PATENT DOCUMENTS

| | | | | |
|---|---|---|---|---|
| 2002/0182987 | A1* | 12/2002 | Shaw | B24C 1/003 451/75 |
| 2004/0005848 | A1* | 1/2004 | Yamaharu | B24C 1/003 451/91 |
| 2008/0176487 | A1* | 7/2008 | Armstrong | B24C 1/003 451/39 |
| 2012/0094581 | A1* | 4/2012 | Sharma | B24C 1/003 451/38 |
| 2013/0139853 | A1* | 6/2013 | Solenthaler | B24C 7/0069 134/7 |

* cited by examiner

DRY ICE AND ABBRASIVE BLASTING MEDIA APPARATUS AND METHOD

CROSS REFERENCE TO RELATED APPLICATIONS

This is a non-provisional application based upon U.S. provisional patent application Ser. No. 62/324,483, entitled "DRY ICE AND ABRASIVE BLASTING MEDIA APPARATUS AND METHOD", filed Apr. 19, 2016, which is incorporated herein by reference.

BACKGROUND OF THE INVENTION

1. Field of the Invention

The present invention relates to a blasting system for cleaning a surface, and, more particularly, to a sublimating and abrasive media blasting system which can intermix a desired amount of abrasive media with a dry ice media.

2. Description of the Related Art

Sand or grit blasting is a widely-known method in the art to clean surfaces, such as walls, floors, ceilings, and various other parts. Although sand blasting is often effective, it has the disadvantages of potentially abrading surfaces. Further, the reusability of the blasting particles is often inefficient or impractical as the particles can be arduous to recollect and/or rendered unusable by being contaminated after use.

Ice blasting is another known method for cleaning surfaces, which overcomes some of the disadvantages of sand or grit blasting. Ice blasting uses frozen media such as dry ice media or ice particles made from water. Frozen media is generally non-abrasive in nature, and it often is more cost effective to obtain and/or manufacture at the worksite than sand blasting. Further, ice blasting is significantly easier to clean up afterwards as compared to sand blasting. Once the frozen ice media has been used, it evaporates which leaves behind only the adherent that was removed from the surface, which then can be readily cleaned. Although an improvement from sand blasting, ice blasting suffers from a disadvantage in that it may not sufficiently clean a heavily contaminated surface because the ice media is not as abrasive as the sand or grit particles.

What is needed in the art is a blasting system that can sufficiently and cost-effectively clean a surface while remaining as non-abrasive as possible to remove the adherent from the surface.

SUMMARY OF THE INVENTION

The present invention provides a sublimating and abrasive media blasting system with the capability of simultaneously issuing a mixture of sublimating media and a variety of different abrasive blast medias.

The invention in one form is directed to a sublimating and abrasive media blasting system that includes an air compressor, a sublimating blasting unit operably connected to the air compressor and configured to supply a sublimating material, and an abrasive media container operably connected to the air compressor and configured to supply an abrasive media. The blasting system also includes a blasting applicator assembly operably connected to the abrasive media container and to the sublimating blasting unit. The blasting applicator assembly includes an applicator operably connected to the sublimating blasting unit, a first trigger configured to control a flow of the sublimating material and a second trigger configured to control a flow of the abrasive media, and an injector. The injector has a first inlet operably connected to the applicator and receiving the sublimating material, a second inlet operably connected to the abrasive media container and receiving the abrasive media, and an outlet. The injector is configured to mix the sublimating material and the abrasive media. The blasting applicator assembly also includes a nozzle connected to the outlet of the injector.

The invention in another form is directed to a sublimating and abrasive media blasting system that includes an air compressor, a sublimating blasting unit operably connected to the air compressor and configured to supply a sublimating material, an abrasive media container operably connected to the air compressor and configured to supply an abrasive media, and an injector. The injector has a first inlet operably connected to the sublimating blasting unit and receiving the sublimating material, a second inlet operably connected to the abrasive media container and receiving the abrasive media, and an outlet. The injector is configured to mix the sublimating material and the abrasive media. The blasting system also includes a blasting applicator assembly. The blasting applicator assembly includes an applicator operably connecting to the outlet of the injector, a first trigger configured to control a flow of fluid entering the applicator and a second trigger configured to control a flow of the abrasive media, and a nozzle connected to the applicator.

The invention in yet another form is directed to a method for cleaning a surface. The method includes the steps of providing a sublimating and abrasive media blasting system. The blasting system includes an air compressor, a sublimating blasting unit operably connected to the air compressor and configured to supply a sublimating material, an abrasive media container operably connected to the air compressor and configured to supply an abrasive media, and a blasting applicator assembly fluidly connected to the abrasive media container and to the sublimating blasting unit such that the blasting applicator receives the sublimating material and the abrasive media. The blasting applicator assembly includes an applicator and a nozzle. A user can selectively choose a desired amount of abrasive media to mix with the sublimating material. The method includes the further step of adjusting the desired amount of abrasive media depending on a condition of the surface.

An advantage of the present invention is that a user can selectively choose a desired amount of abrasive media to mix in with the dry ice media.

Another advantage of the present invention is that a surface can be cleaned with a proportionate amount of abrasive media such that the surface can be sufficiently cleaned without being abraded.

Yet another advantage of the present invention is that a surface may be cleaned without the use of water, chemicals, or heat.

Still another advantage of the present invention is that the clean-up process after cleaning a surface can be more efficient as there is minimal to no media to clean up.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DESCRIPTION OF THE INVENTION

Figure 1:
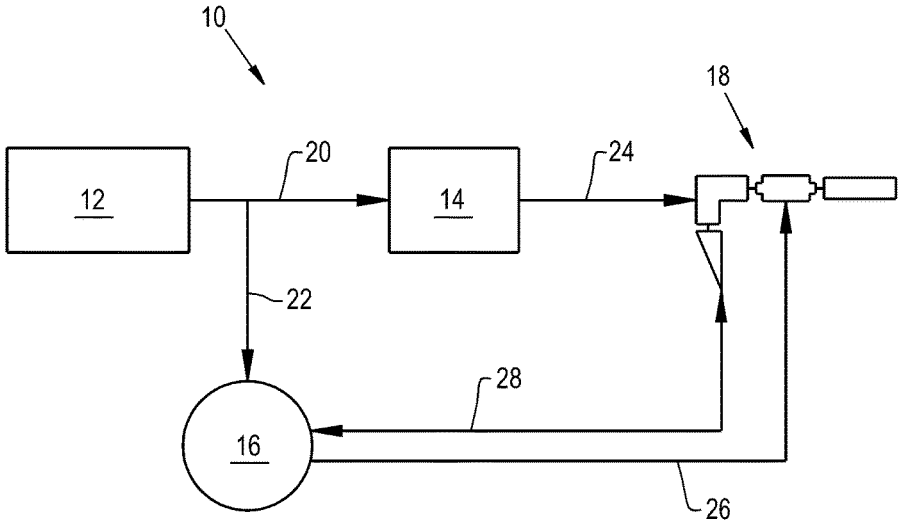
FIG. 1 is a schematic diagram illustrating an embodiment of a dry ice and abrasive media blasting system according to the present invention.
Figure 2:
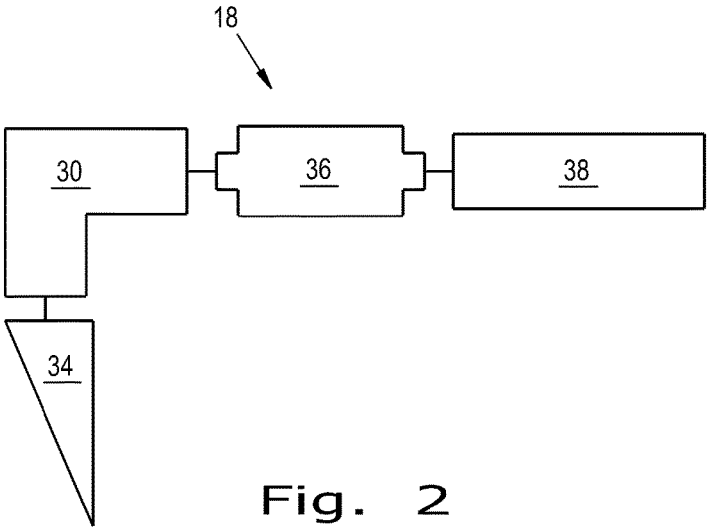
FIG. 2 is a schematic diagram illustrating the blasting applicator assembly as shown in FIG. 1.
Figure 3:
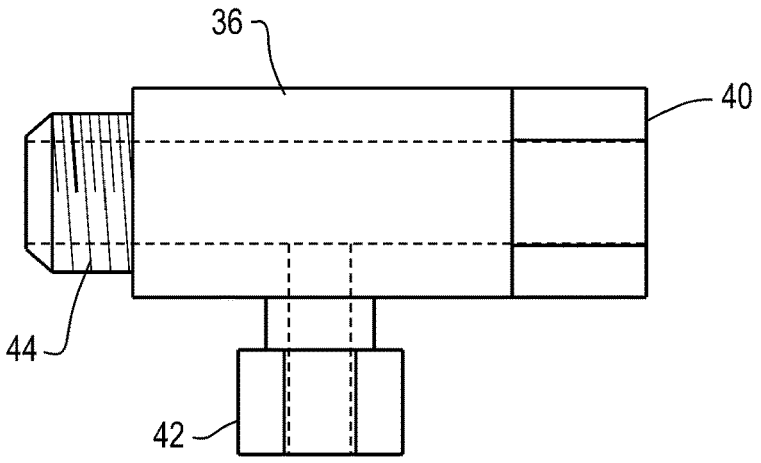
FIG. 3 is a side view of an embodiment of the injector of the dry ice and abrasive media blasting system as shown in FIG. 1.

Referring now to the drawings, and more particularly to FIG. 1, there is shown an embodiment of a dry ice and abrasive media blasting system 10, which generally includes an air compressor 12, a dry ice blasting unit 14, an abrasive media container 16, and a blasting applicator assembly 18. The dry ice and abrasive media blasting system 10 may additionally be referred to as an Augmented Integrated Media (A.I.M.) system.

The air compressor 12 supplies compressed air to the dry ice blasting unit 14 and to the abrasive media container 16. The air compressor 12 is operably connected to the dry ice blasting unit 14 and abrasive media container 16 via air hoses 20 and 22, respectively. The air compressor 12 can be any air compressor known in the art that can supply a sufficient amount (cfm) and pressure (psi) of compressed air.

The dry ice blasting unit 14, connected to the air compressor 12 by air hose 20, is configured to supply sublimating material to the blasting applicator assembly 18 through a dry ice blast hose 24. The sublimating material may include dry ice media which can be in the form of dry ice particles such as small cylindrical, spherical, and/or rectangular shaped particles. The dry ice media may also be in the form of pellets, blocks, nuggets, shaved particles, etc. Alternatively, the cleaning medium may be in the form of ice made from water instead of dry ice media. The dry ice blasting unit 14 may create its own ice particles using various internal systems or it may store prefabricated ice particles. Dry ice blasting unit 14 can be any commercially available dry ice blaster known in the art.

The abrasive media container 16, connected to the air compressor 12 by hose 22, is configured to contain the abrasive media and supply the abrasive media to the blasting applicator assembly 18 through an abrasive media blast hose 26. The abrasive media container 16 may be pressurized by the compressed air flowing from the air compressor 12 such that the abrasive media is forced out through the abrasive media blast hose 26 to the blasting applicator assembly 18. Alternatively, the abrasive media container 16 may be configured such that a vacuum force draws the abrasive media out from the abrasive media container 16 through the abrasive media blast hose 26 to the blasting applicator assembly 18. In the present embodiment, the abrasive media container 16 is in the form of an abrasive media pot. The abrasive media pot may be any commercially available media pot known in the art. The abrasive media may be in the form of any desired abrasive particle, for example, metal, composite, plastic, and/or glass particles. Additionally, a control line 28 may be connected between the abrasive media container 16 and the blasting applicator assembly 18 in order to regulate the flow of the abrasive media. The control line 28 may be in the form of a pneumatic twin line hose or an electrical control cable.

Referring now collectively to FIGS. 2-5, the blasting applicator assembly 18 includes an applicator 30, a first and second trigger 32, 34, an injector 36, and a nozzle 38. As described above, the blasting applicator assembly 18 is respectively connected to the dry ice blasting unit and the abrasive media container via hoses 24 and 26. The blasting applicator assembly 18 allows a user to selectively choose a desired amount of abrasive media to mix with the dry ice media in order to a clean a surface.

The applicator 30 is operably connected to the dry ice blasting unit 14 by the dry ice blast hose 24. The applicator 30 receives the dry ice media from the dry ice blasting unit 14 and channels the dry ice media to the injector 36. The applicator 30 may function as a dry ice blasting (DIB) applicator (dry ice only) or an augmented integrated media (AIM) applicator (dry ice and abrasive media). The applicator 30 may be in the form of a blasting gun or a known variant thereof.

The first trigger 32 controls the flow of the dry ice media flowing through the applicator 30, and the second trigger 34 controls the flow of the abrasive media. The first trigger 32, which is the dry ice blasting trigger, can be located at the handle of the applicator 30, and it may be built into the applicator 30. The first trigger 32 can be in the form of an electrical trigger. In this regard, an electrical control cable may be provided between the dry ice blasting unit 14 and the first trigger 32 in order to meter the flow of the dry ice media.

Figure 5:
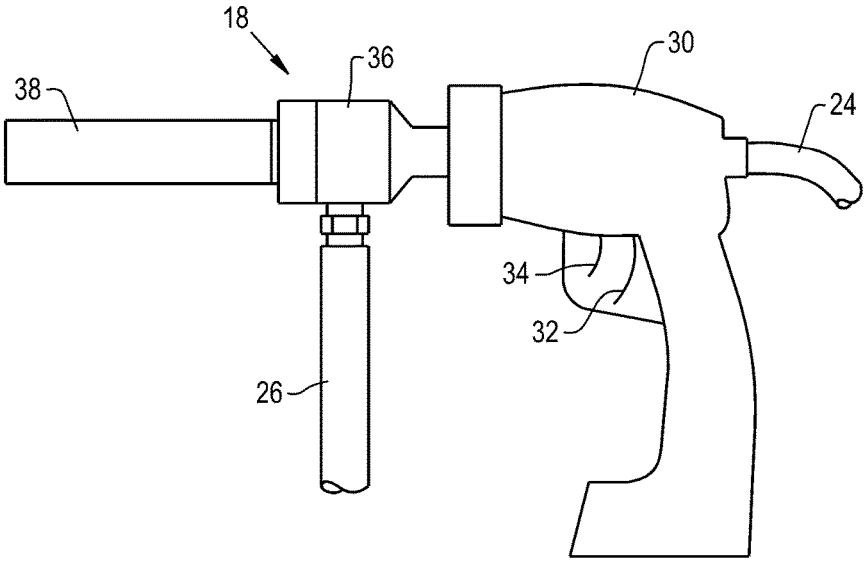
FIG. 5 a side view of an embodiment of the blasting applicator assembly of the dry ice and abrasive media blasting system according to the present invention.

The second trigger 34, which is the abrasive media trigger, can be selectively attached or permanently located on the applicator 30. For example, as shown in FIG. 5 the second trigger 34 is shown to be integrated with and built into the applicator 30. Alternatively, the second trigger 34 may be designed as a separate part and thereby may be separately affixed or removably attached to the body, e.g. the handle, of applicator 30 (discussed below with respect to FIG. 6). The second trigger 34 may even be separately included such that it is not directly attached to the applicator 30. In the present embodiment, the second trigger 34 is in the form of a pneumatic trigger; however, the second trigger 34 may be designed as an electric trigger.

The injector 36 is in the form of an injection chamber that has two inlets 40, 42 and one outlet 44. The injector 36 is located downstream of the applicator 30 in the direction of fluid flow (i.e. the air flow). The first inlet 40 is the dry ice media inlet, which is connected to the applicator 30 and receives the dry ice media. The second inlet 42 is the abrasive media inlet that is connected to the abrasive media container 16 and receives the abrasive media. The injector 36 is configured to mix the dry ice media and the abrasive media together. Depending upon a user's preferences, a user may actuate the second trigger 34 to provide more or less abrasive media in the mixture that is ejected out of the nozzle 38.

Figure 4:
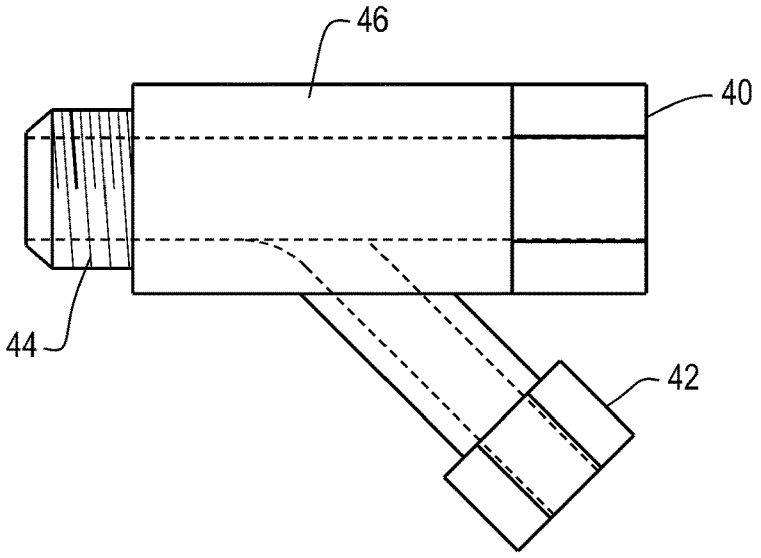
FIG. 4 is a side view of another embodiment of the injector of the dry ice and abrasive media blasting system according to the present invention.

The injector 36 may have a "T" shaped configuration (FIG. 3), or the injector 36 may be configured to be a slanted injector 46 such that the second inlet 42 extends outwardly at an angle (FIG. 4). However, the second inlet 42 may be positioned in any desired orientation, for example, the second inlet 42 may be positioned on top of or on the side of the injector 36 and extend forwardly or rearwardly (not shown). The connections at the inlets 40, 42 and the outlet 44 may include any combination of threaded male or female mating ends, quick connect couplers, fixed couplers, swivel couplers, and/or fittings.

The injector 36 is shown to be a separate part that is coupled to the applicator 30. Thereby, the injector 36 may be removably attached to the applicator 30 such that the applicator 30 can easily switch between dry ice blasting only and augmented integrated media blasting. It is possible, however, to have a blasting applicator assembly 18 that includes an injector integrated with the applicator 30 and/or nozzle 38, or custom fittings on the applicator 30 and/or nozzle 28 to achieve desired results.

The nozzle 38 is connected to the outlet 44 of the injector 36. The nozzle 38 may be in the form of any nozzle known in the art.

Figure 6:
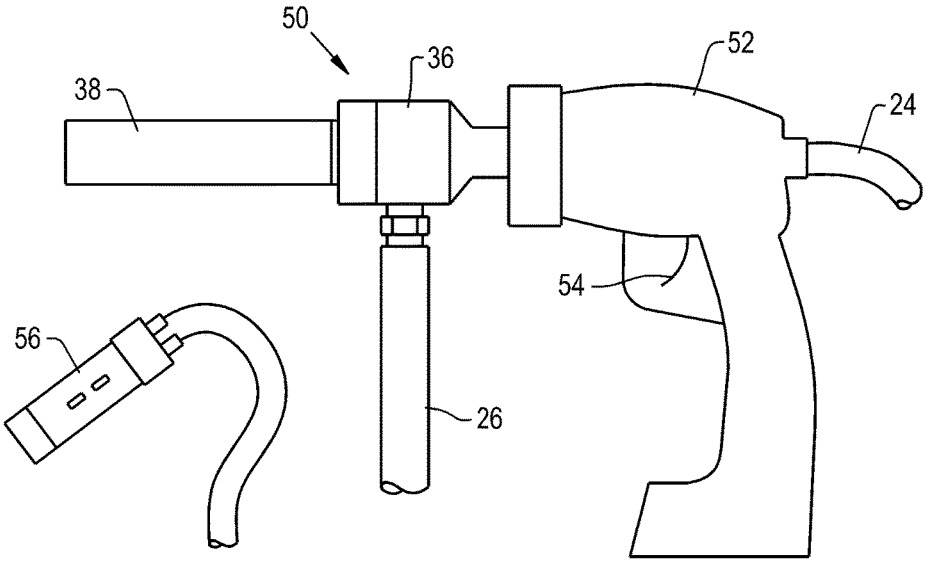
FIG. 6 a side view of another embodiment of the blasting applicator assembly of the dry ice and abrasive media blasting system according to the present invention.

Referring now to FIG. 6, there is shown another embodiment of a blasting applicator assembly 50 which includes an applicator 52, a dry ice media trigger 54 integrated with the applicator 52, an abrasive media trigger 56 in the form of a separate handheld trigger, an injector 36, and a nozzle 38. The blasting applicator assembly 50 may operate as the blasting applicator assembly 18 as described above, and it may be employed in a dry ice and abrasive media system 10.

The handheld second trigger 56 can be used separately from the applicator 52 or it may be removably attached to the applicator 52. As shown, the handheld second trigger 56 is in the form of a pneumatic trigger that is connected to the abrasive media container 16 via the control line 28, which in this embodiment is in the form a pneumatic twin line hose. With the handheld second trigger 56, a user has the convenience of holding the handheld second trigger 56 for easy adjustments, attaching it to the applicator 52, or even storing it during times when it is not in use.

Figure 7:
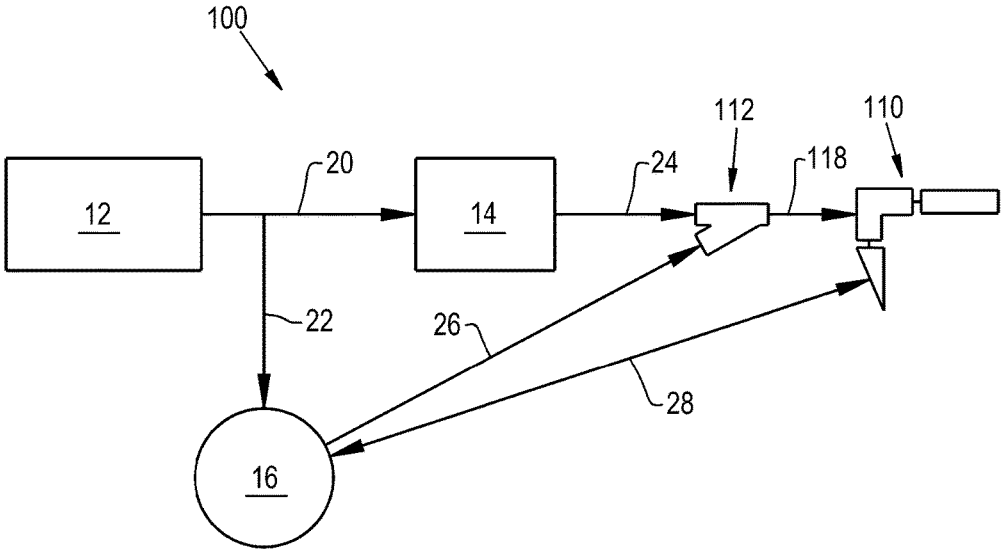
FIG. 7 is a schematic diagram illustrating another embodiment of a dry ice and abrasive media blasting system according to the present invention.
Figure 8:
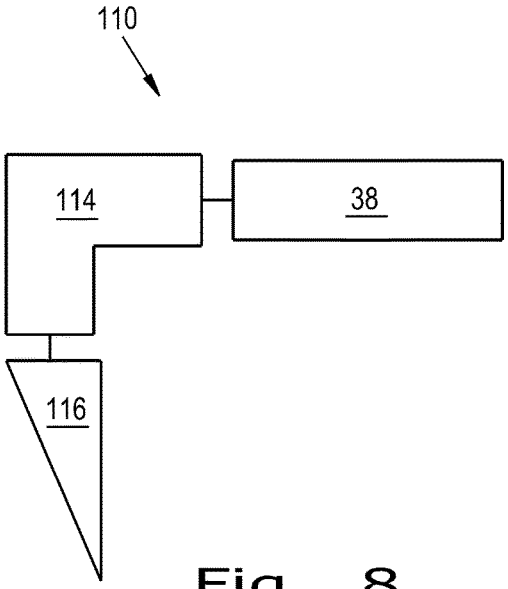
FIG. 8 is a schematic diagram illustrating the blasting applicator assembly as shown in FIG. 7.

Referring now to FIGS. 7 and 8, there is shown another embodiment of a dry ice and abrasive media blasting system 100 according to the present invention. The dry ice and abrasive media blasting system 100 generally includes the air compressor 12, dry ice blasting unit 14, abrasive media container 16, a blasting applicator assembly 110, and an injector 112. The blasting system 100 is configured and functions as does the blasting system 10, except that dry ice media and the abrasive media are mixed by the injector 112 before flowing into the blasting applicator assembly 110.

The blasting applicator assembly 110 includes an applicator 114, a first trigger and second trigger 116, and a nozzle 38. The applicator 114 is operably connected to the injector 112 via blast hose 118. The blast hose 118 may include an electrical control cable for operably connecting the applicator 114 to the injector 112 such that the first trigger can meter the flow of fluid entering in the applicator 114. It should be appreciated that the applicator 114 may be in the form of and function as either applicator 30 or applicator 50 as described above. The first trigger controls a flow of fluid entering the applicator 114, and the second trigger 116 controls a flow of fluid of the abrasive media entering the injector 112. The second trigger 116 is operably coupled to the abrasive media container 16 via control line 28. It should also be appreciated that the triggers may be designed and function as triggers 32 and 34 or 54 and 56 as described above.

The injector 112 is operably connected to the dry ice blasting unit 14 at a first inlet via hose 24 and to the abrasive media container 16 at a second inlet via hose 26. The outlet of the injector 112 operably couples to the applicator 114 via hose 118. When viewed in the direction of fluid flow, the injector 112 is positioned upstream from (i.e. before) the applicator 114. It should be appreciated that the injector 112 may also be directly connected to the applicator 114 without the use of hose 118 (not shown). The injector 112 is shown to be slanted; however, it may be configured as either injector 36 or 46, or may be oriented in any other desired fashion.

Figure 9:
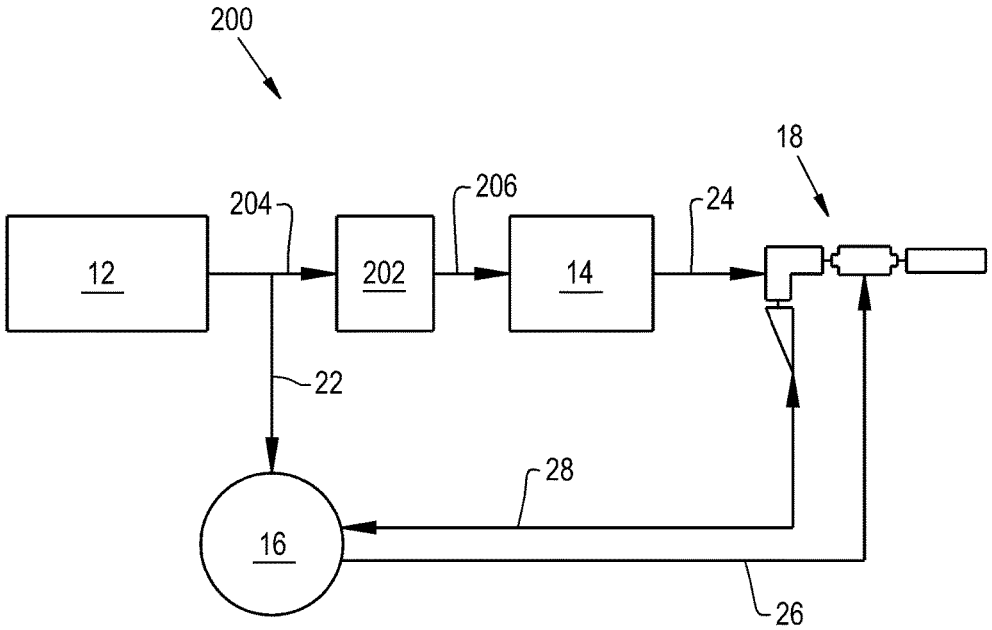
FIG. 9 is a diagram illustrating another embodiment of a dry ice and abrasive media blasting system according to the present invention.

Referring now to FIG. 9, there is shown another embodiment of a dry ice and abrasive media blasting system 200 which additionally incorporates a dehumidifier 202 for treating the compressed air from the air compressor 12 prior to use in the dry ice blasting unit 14. Dehumidifier 202 can be any dehumidifier or aftercooler suitable for the purpose of treating compressed air. Dehumidifier 202 is connected to the air compressor 12 via hose 204. Dehumidifier 202 is in turn connected to dry ice blasting unit 14 by way of hose 206. It should be appreciated that the dehumidifier may be incorporated in either dry ice and abrasive blasting system 10 or dry ice and abrasive blasting system 100.

Not shown in FIGS. 1-9 are other implements normally required for blasting operations, such as electrical connections, regulators, valves, fittings, etc. The regulators, for example, must be capable of delivering pressures of 75-90 pounds per square inch (psi) for the abrasive blasting media and up to 200 psi or more for the dry ice. It is understood that various pressures and mixtures can be obtained by adjusting valves and regulators on the various components.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A sublimating and abrasive media blasting system, comprising:

an air compressor;

a sublimating blasting unit operably connected to the air compressor and configured to supply a sublimating material;

an abrasive media container operably connected to the air compressor and configured to supply an abrasive media; and a blasting applicator assembly operably connected to the abrasive media container and to the sublimating blasting unit, the blasting applicator assembly including:

an applicator operably connected to the sublimating blasting unit;

a first trigger configured to control a flow of the sublimating material and a second trigger configured to control a flow of the abrasive media;

an injector having a first inlet operably connecting to the applicator and receiving the sublimating material, a second inlet operably connecting to the abrasive media container and receiving the abrasive media, and an outlet, the injector is configured to mix the sublimating material and the abrasive media; and a nozzle connected to the outlet of the injector.

2. The sublimating and abrasive media blasting system of claim 1, wherein said injector is located downstream from the applicator in a direction of fluid flow.

3. The sublimating and abrasive media blasting system of claim 1, wherein a user can selectively choose a desired amount of abrasive media to mix with the sublimating material by actuating the second trigger.

4. The sublimating and abrasive media blasting system of claim 1, wherein the second trigger is in the form of a handheld trigger.

5. The sublimating and abrasive media blasting system of claim 1, wherein the second trigger is located on the applicator.

6. The sublimating and abrasive media blasting system of claim 1, wherein said sublimating material is in the form of a dry ice media.

7. The sublimating and abrasive media blasting system of claim 1, further including a dehumidifier operably connected to the air compressor and configured to treat a compressed air from the air compressor prior to use in the sublimating blasting unit.

8. A sublimating and abrasive media blasting system, comprising:

an air compressor;

a sublimating blasting unit operably connected to the air compressor and configured to supply a sublimating material;

an abrasive media container operably connected to the air compressor and configured to supply an abrasive media;

an injector having a first inlet operably connecting to the sublimating blasting unit and receiving the sublimating material, a second inlet operably connecting to the abrasive media container and receiving the abrasive media, and an outlet, the injector is configured to mix the sublimating material and the abrasive media; and a blasting applicator assembly, including:

an applicator operably connecting to the outlet of the injector; a first trigger configured to control a flow of sublimating material entering the applicator and a second trigger configured to control a flow of the abrasive media; and a nozzle connected to the applicator.

9. The sublimating and abrasive media blasting system of claim 8, wherein said injector is positioned upstream from the applicator in a direction of sublimating material flow.

10. The sublimating and abrasive media blasting system of claim 8, wherein a user can selectively choose a desired amount of abrasive media to mix with the sublimating material by actuating the second trigger.

11. The sublimating and abrasive media blasting system of claim 8, wherein the second trigger is in the form of a handheld trigger.

12. The sublimating and abrasive media blasting system of claim 8, wherein the second trigger is located on the applicator.

13. The sublimating and abrasive media blasting system of claim 8, wherein said sublimating material is in the form of a dry ice media.

14. The sublimating and abrasive media blasting system of claim 8, further including a dehumidifier operably connected to the air compressor and configured to treat a compressed air from the air compressor prior to use in the sublimating blasting unit.

15. A method for cleaning a surface, comprising the steps of: providing a sublimating and abrasive media blasting system, including:

an air compressor;

a sublimating blasting unit operably connected to the air compressor and configured to supply a sublimating material;

an abrasive media container operably connected to the air compressor and configured to supply an abrasive media; and a blasting applicator assembly fluidly connected to the abrasive media container and to the sublimating blasting unit such that the blasting applicator receives the sublimating material and the abrasive media, the blasting applicator assembly including:

an applicator; and a nozzle, wherein a user can selectively choose a desired amount of abrasive media to mix with the sublimating material; and adjusting the desired amount of abrasive media depending on a condition of the surface, wherein said blasting applicator assembly further includes a first trigger configured to control a flow of fluid entering the applicator and a second trigger configured to control a flow of the abrasive media.

16. The method of claim 15, further including an injector operably connected to the applicator and configured to mix the sublimating material and the abrasive media.

17. The method of claim 15, wherein the second trigger is in the form of a handheld trigger.

18. The method of claim 15, wherein the second trigger is located on the applicator.

19. The method of claim 15, wherein said sublimating material is in the form of a dry ice media.

* * * * *